US005924693A

United States Patent [19]

Beaumier et al.

[11] Patent Number: 5,924,693

[45] Date of Patent: Jul. 20, 1999

[54] GOLF BOARD GAME

[75] Inventors: Mario Beaumier, Laval; Benoît Kelly, Montreal, both of Canada

[73] Assignee: Corporation des Jeux de Société le Golf, Montreal, Canada

[21] Appl. No.: 08/913,564

[22] PCT Filed: Mar. 17, 1995

[86] PCT No.: PCT/CA95/00141

§ 371 Date: Nov. 10, 1997

§ 102(e) Date: Nov. 10, 1997

[87] PCT Pub. No.: WO96/29130

PCT Pub. Date: Sep. 26, 1996

[51] Int. Cl.[6] ..... A63F 3/00

[52] U.S. Cl. ..... 273/245; 273/245; 273/242; 273/243; 273/248; 273/249

[58] Field of Search ..... 273/245, 242, 273/243, 248, 249

[56] References Cited

U.S. PATENT DOCUMENTS 3,647,216 3/1972 Breslow .
3,857,568 12/1974 Yoder .
4,364,569 12/1982 Duwell et al. .
4,809,985 3/1989 Trimble .
5,000,460 3/1991 Barbiauz et al. .
5,234,218 8/1993 LaRocca .
5,316,302 5/1994 Sedberry .

FOREIGN PATENT DOCUMENTS 94 11 350 U 12/1994 Germany .

*Primary Examiner*—William E. Stoll
*Attorney, Agent, or Firm*—Guy Houle; David M. Carter

[57] ABSTRACT

A golf board game is comprised of a playing surface on which there is contained a plurality of designs representing golf links. Each golf link has a starting area, a fairway area and a green area. Distance indicating markers are provided on the fairway and green areas. At least one manually displaceable element is supportable on the playing surface. A first displacement indicating manually displaceable element is provided over the fairway area. A second displacement indicating element is also provided to cause displacement of the displaceable element towards an objective associated with the green area. Play money is associated with the golf game as well as a plurality of distinct groups of cards utilized to instruct a player under predetermined situations during play.

24 Claims, 5 Drawing Sheets

GOLF BOARD GAME

TECHNICAL FIELD

The present invention relates to a golf board game having a playing surface on which golf links are printed and having distance indicating means provided thereon and wherein one or more manually displaceable elements are displaced in accordance with a first displacement indicating means to move it over a fairway area and a second displacement indicating means to move it over a green area towards an objective thereon.

BACKGROUND ART

Various golf board games are known comprising a playing surface printed on a board and on which a displaceable element is moved from a tee area, over a fairway area and on to a green area. However, these games utilize a single displacement indicating means to displace the manually displaceable element over the board. Some of these games also teach the rules of golf to players.

SUMMARY OF THE INVENTION

It is a feature of the present invention to provide a new golf board game of the above type and utilizing different displacement indicating means for displacing an element over the fairway area and the green area and wherein the players can also practice their real putting skills while playing the game.

According to the above features, from a broad aspect, the present invention provides a golf game which comprises a playing surface on which there is contained a plurality of designs representing golf links. Each of the golf links has a starting area, a fairway area and a green area. Distance indicating means is provided on the fairway and green areas. At least one manually displaceable element is supportable on the playing surface. First displacement indicating means is provided for the displacement of the at least one manually displaceable element over the fairway area. A second displacement indicating means is also provided to cause displacement of a displaceable element towards an objective associated with the green area.

BRIEF DESCRIPTION OF DRAWINGS

A preferred embodiment of the present invention will now be described with reference to the accompanying drawings in which.

DESCRIPTION OF PREFERRED EMBODIMENTS

Figure 1A:
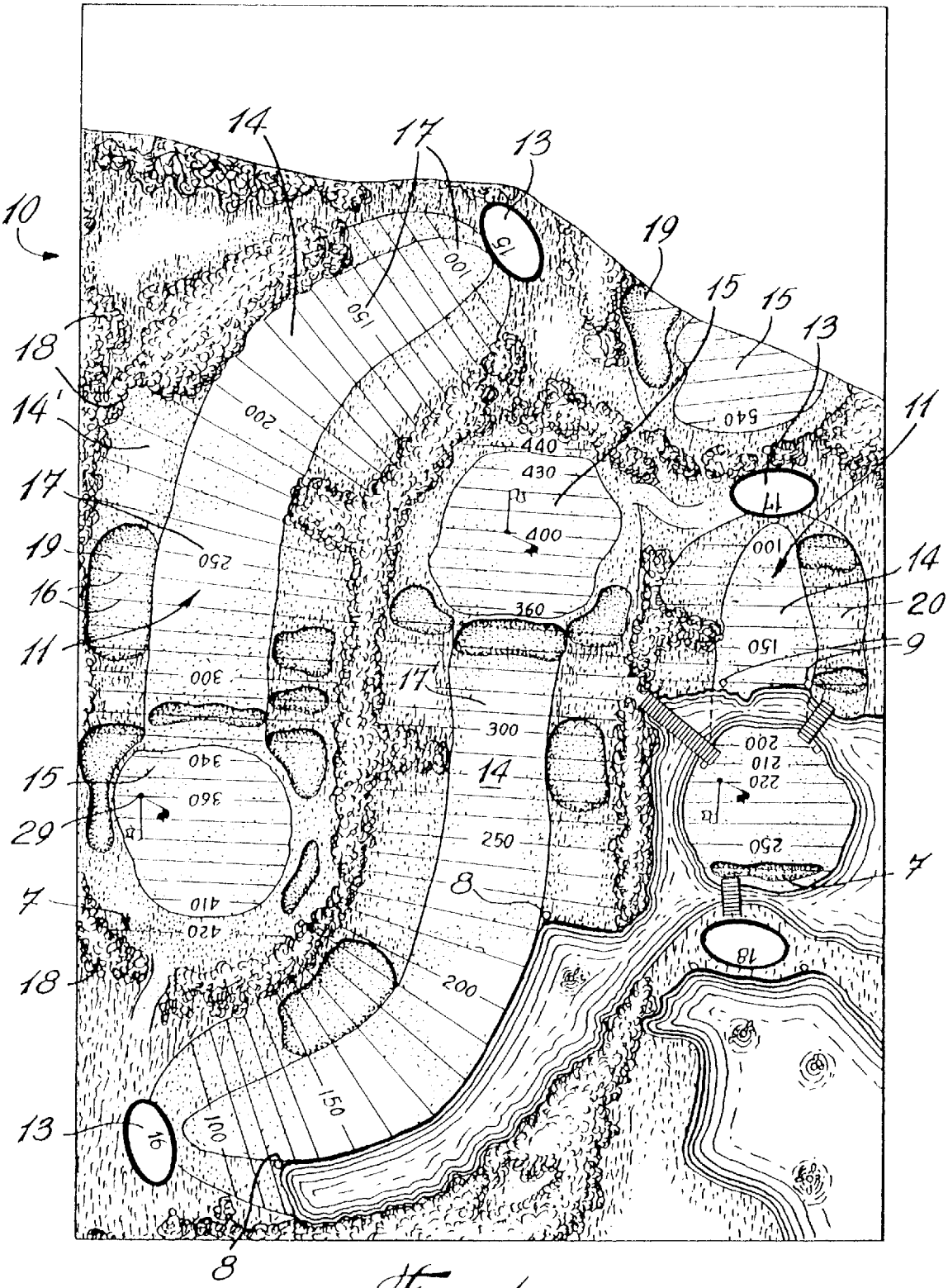
FIGS. 1A and 1B are fragmented plan views showing a portion of the playing surface of the board game.
Figure 1B:
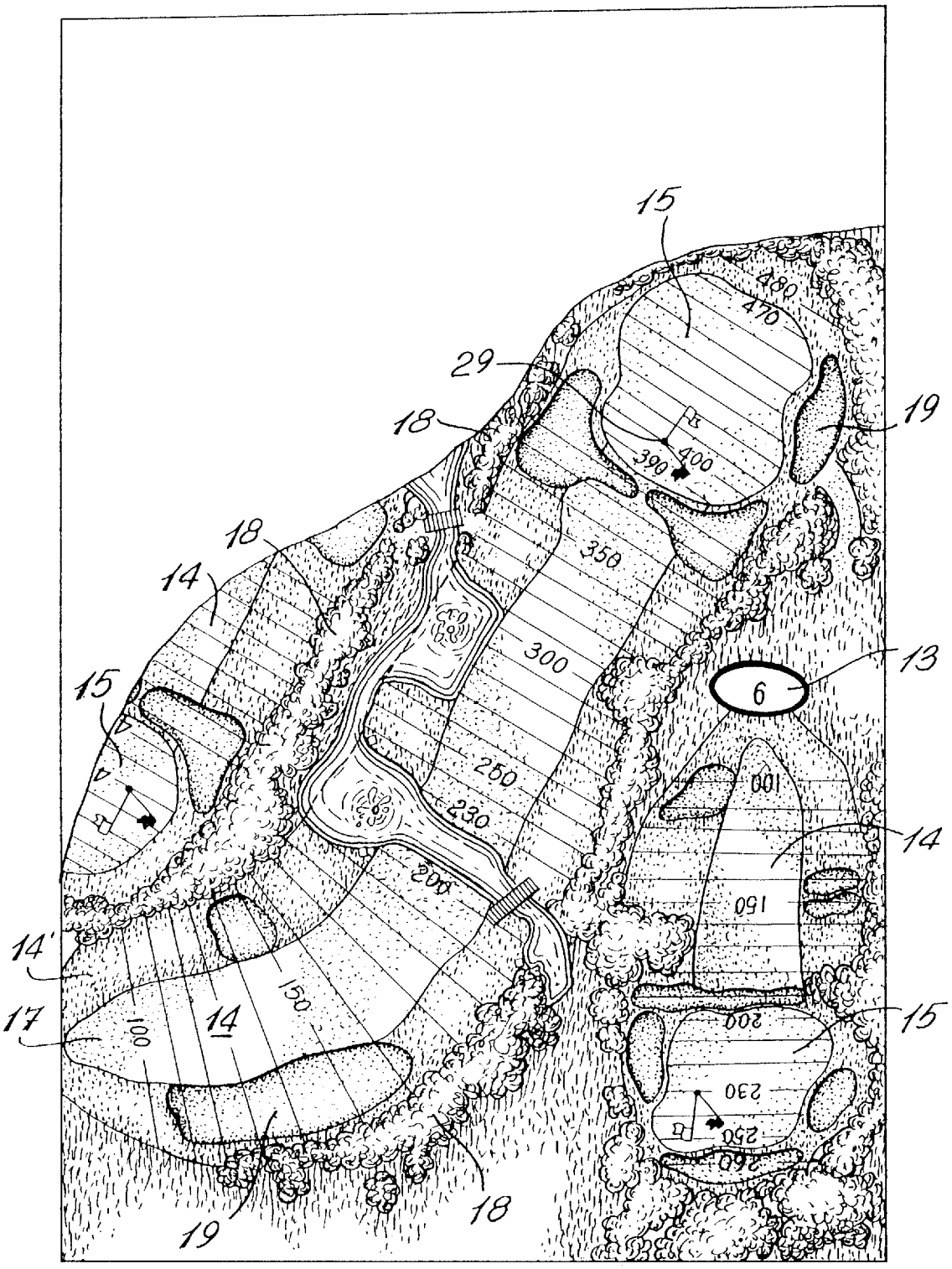

Referring now to the drawings and more particularly to FIGS. 1A and 1B is shown generally at 10 portions a board having golf links 11 printed thereon. As board has a central folding crease for folding the board in two sections. Golf links 11 are also printed on the backside of the board, although not shown. The board containing eighteen golf links 11.

Each of the golf links 11 has a starting area 13, a fairway area 14 and a green area 15. Distance indicating means in the form of transverse lines 16 extend over the fairway area 14 and the green areas 15. At least some of these transverse lines have distance markers 17 printed thereon. The distance markers 17 are calculated from the tee area 13 to the green area 15. Other distance markers may be provided to indicate some of the distance remaining in the fairway area to an objective, herein a golf hole 29, on the green area 15.

The fairway area 14 is delineated by contour links or a color different from the rough side areas 14' on opposed sides thereof and constituting alleys. Outside the "rough" side areas 14' we find wooded areas 18 or other hazards. Also provided are sand trap areas 19 and water hazard areas 20 printed on the board in the fairway areas 14, the rough areas 14' and around the green areas 15. Drop zone markers 8 may be positioned laterally of a hazard or transversely thereto as shown at 9 to indicate where the displacement element is to be positioned back on the fairway area after a penalty stroke is taken or as otherwise instructed by the penalty cards. Limit lines 7 are also provided at the end of green areas 15 indicating where a displaceable element is positioned if it is to be placed far beyond the markings 17 on the links 11.

Figures 2A, 2B:
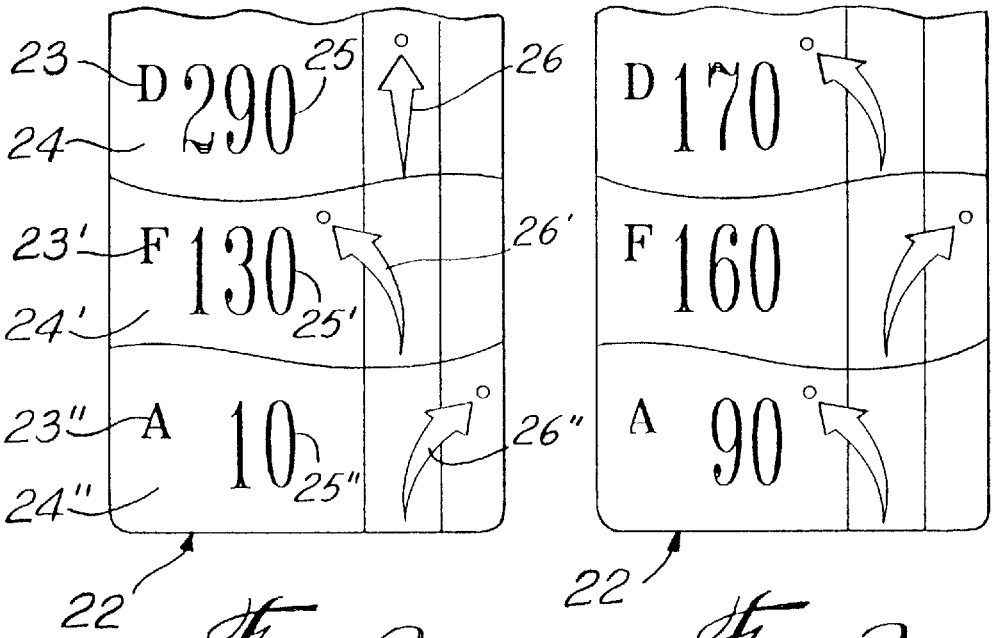
FIGS. 2A and 2B are planned views of displacement indicating cards which are used to displace the manually displaceable element in the fairway area.
Figure 3:
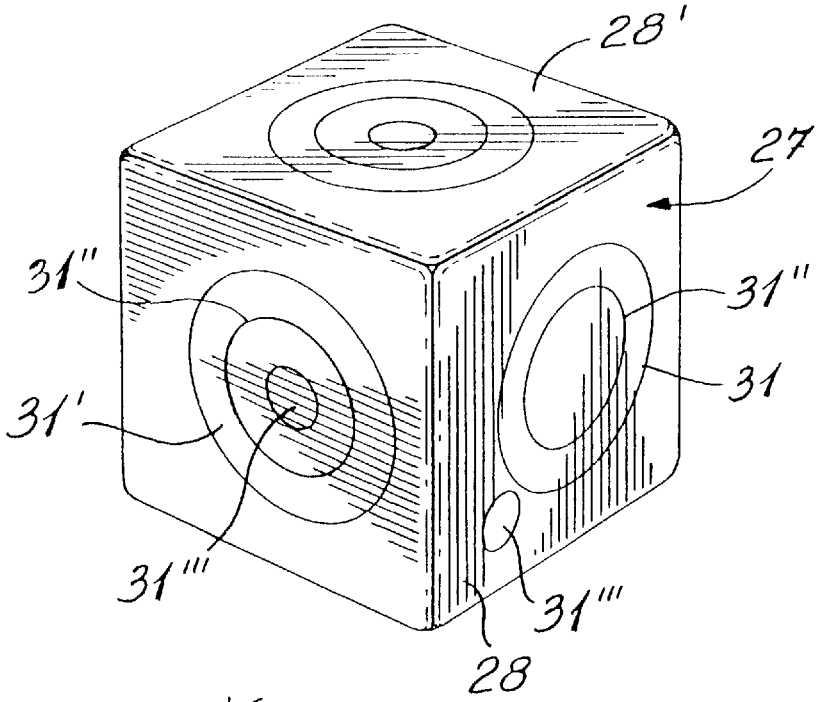
FIG. 3 is a perspective view of a pair of dice which are used to displace the displaceable element on the green area.
Figure 6:
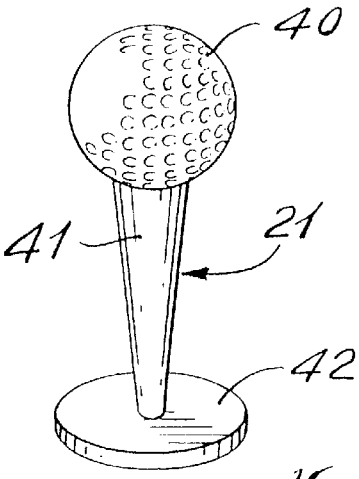
FIG. 6 is a perspective view of a manually displaceable element.
Figure 7:
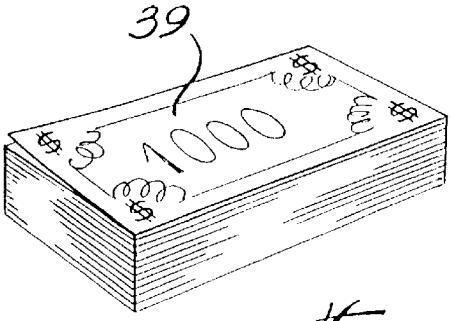
FIG. 7 is a perspective view of the play money utilized.

Referring now to FIGS. 2A, 2B and 3 there will be described the construction of the displacement indicating means whereby to effect displacement of the manually displaceable elements 21, as shown in FIG. 6, and supported over the game board playing surface 6. Each player is provided with a manually displaceable element 21 and the game may be played by one or more players. These elements 21 are firstly positioned at the starting area 13 and are displaced over the game board from the starting area to the green 15 depending on the instructions for displacement as selected from the displacement indicating cards 22, two of which are shown in FIGS. 2A and 2B.

As shown in FIGS. 2A and 2B, each player is provided with a predetermined number of these displacement indicating cards. Each card has printed on a surface thereof at least two distinct sections, herein three sections 24, 24' and 24", each having a location marking 23, 23' and 23". Each section is also provided with a distance number 25, 25' and 25" which is associated with the location markings 23, 23' and 23". As well, each section is further provided with a direction indicator 26, 26' and 26". Each player, in consecutive order, must select instructions from these sections 24, 24' and 24" of one of his cards depending on the position of his displaceable element 21 on the golf link 11.

At the beginning of the game when the displaceable element is at the starting area 13 a player must select one of the instructions from the cards that he possesses in the location marking 23 (D) which is associated with a golf drive. He then displaces his displaceable element in the direction of the arrow or direction indicator 26. If the arrow is straight, he remains in the fairway area 14. If curved to the right or left, he goes into the rough areas 14' to the right or left of the fairway area. If a displaceable element 21 is in a rough area on the right of the fairway after a drive (D) and he must play in a curved right direction in accordance with (F) instructions, he will be in a wooded hazard area on the right side. If the approach (A) displacement direction is curved left, then he repositions his element 21 on the fairway area. If the arrow is straight he remains in the right rough area 14'. If the fairway (F) 23' instructions places the element 21 on the green area 15, then the arrow instructions are disregarded. The same applies to the approach (A) 23" instructions.

After the approach instructions 23", 25" the displaceable element may be on the green area 15. If it is on the green area then the player must use one of two dice, only one die 27 being shown in FIG. 3. If the displaceable element is still in the fairway area, rough or hazards then the user, must use the cards until the displaceable element is safely on the green area 15.

Figure 8:
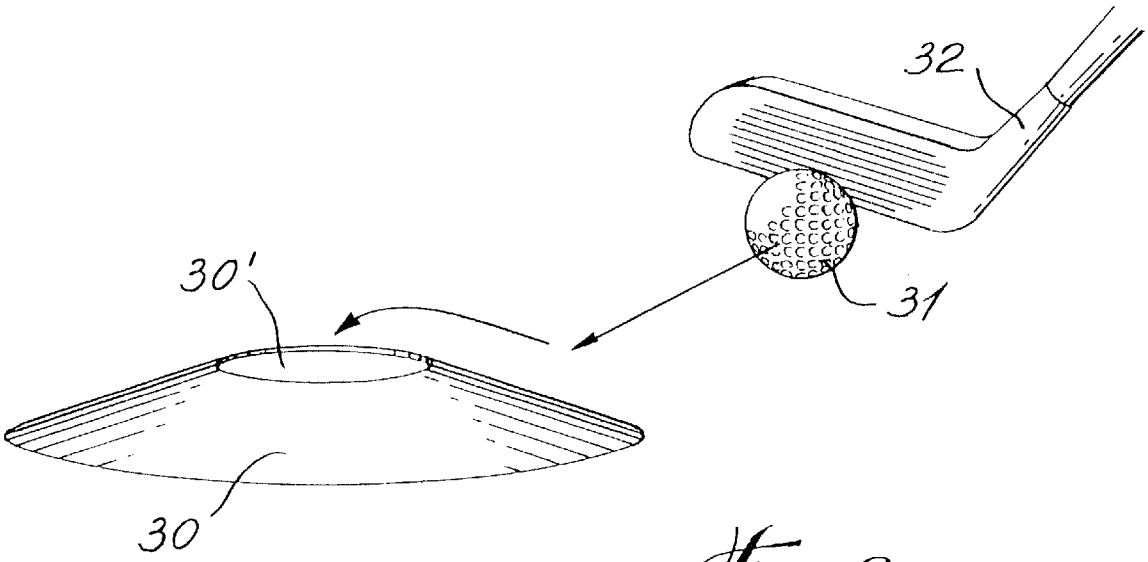
FIG. 8 is a perspective view of a golf cup element supportable on a ground surface showing a real golf ball and real putter used in combination therewith.

Once the displaceable element is on the green area, depending as to how the players elect to play the game, they then utilize a second displacement indicating means which may be a pair of dice 27, shown in FIG. 3 or else a golf cup element 30 as shown in FIG. 8 together with a real golf ball 31 and a real putter 32. How the putting game is played on the floor will be described later.

If the players elect to play the putting game on the green area 15 by the use of the dice 27 they follow the following procedure. There are two dice 27 of different colors for example, red and green. The red dice is utilized if the displaceable element is outside the objective by 10 or 20 yards which is predetermined. The objective is herein a golf cup 29 represented on the green area by a dot and a flag pole. Each of the dice has on its faces 28 thereof two insignia. The first insignia 31 is constituted by a circle 31" and a large dot 31''', representing a golf ball, disposed outside the circle. On another face thereof the dot 31''' is inside the circle 31" such as shown by insignia 31'. When the player is more than 20 yards from the golf cup 29 he utilizes the red die which has twice as many insignia 31 as insignia 31'. If the die is rolled with insignia 31 on the top face 28' of the die then this means that he has missed his putt but is close the cup 29. He must then roll the green die which contains more insignias 31' than insignias 31. If the die lands with the insignia 31' on the top surface 28' then this signals that he has made the putt and he counts a single stroke. Each time a putt is missed a stroke is counted and a score of these strokes is kept by each player.

If the players elect to play the putting game by the use of the cup 30, the golf ball 31 and a real putter 32, then when their displaceable element 21 lands on the green area 15 it is at a specific distance from the cup 29 as determined by the grid links 17. Distance indicator cards 33 are placed on the floor to simulate the distance marks or grid lines 17 on the game board. Therefore, the player will place the real golf ball 31 on the floor surface, at a predetermined location depending on the position and spacing of the cards 33, and strike the ball with the putter to enter the hole 30' which is elevated at the center of the sloping cup 30. The cup 30 is a cone shaped saucer-like element having a hole at the center thereof.

Figure 9:
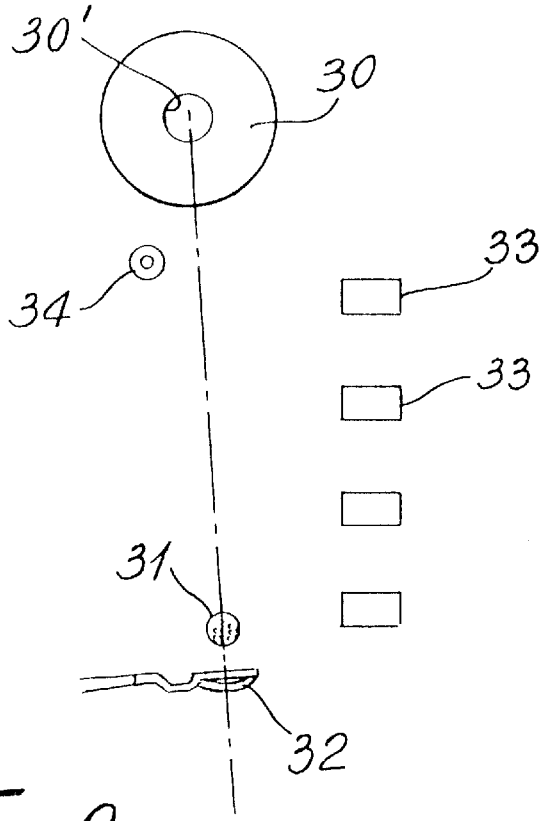
FIG. 9 is a schematic view as showing the elements of FIG. 8 in use and using marker elements to simulate the distance indicating means provided on the green area of the game board.

When playing the putting game on the floor surface using the putting hole 30 with a real golf ball, the golf ball 31 is positioned at a predetermined distance from the golf hole or cup 30' and this distance is calculated as a function of the distance between the displaceable element and the cup 29 on the green area 15. For example, as shown in FIG. 9 the distance markers or lines 17 are simulated by the placement of cards 33 at equal spacing. The spacing between the cards may be a foot on the floor area and this would be equivalent to the spacing between two of the grid line marker 17 which simulates 10 yards apart. Furthermore, obstacles 34 may be prepositioned on the floor area, as agreed by all players, to render the game more difficult. If the player misses the hole 30' he then keeps putting until the ball is in the hole 30' and keeps count of his strokes, like the rolling of the green die 27..

Figure 4A:
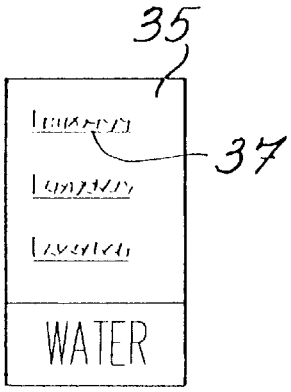
FIGS. 4A, 4B and 4C are planned views of cards which are utilized and contain instructions when the manually displaceable element is displaced to a hazard area.
Figure 4B:
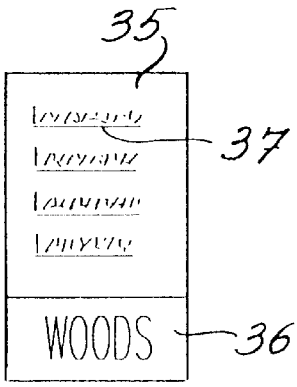
Figure 4C:
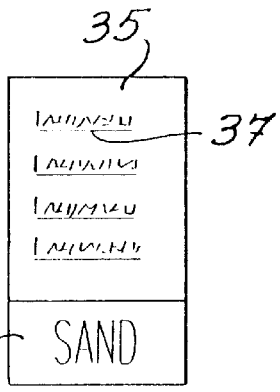
Figure 5A:
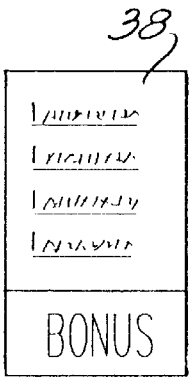
FIGS. 5A, 5B and 5C are planned views of other categories of cards which carry instructions and which are used for other purposes of the game including the transfer of play money.
Figure 5B:
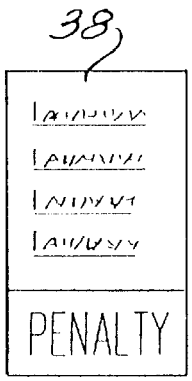
Figure 5C:
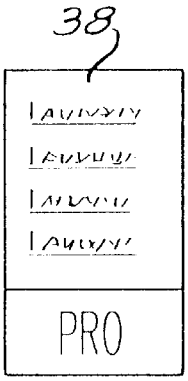

If during play the displaceable element 21 is in a hazard, such as the wooded areas 18 or sand trap 19 or water hazard 20, then the player must select a card from stacks of cards 35, as shown in FIG. 4 and having identification markings 36 to indicate the hazard associated therewith. Each of the cards 35 contain messages 37 thereon advising the player of penalties or of instructions of a different nature. Depending on the score of a player in any hole or line, he may be instructed to select a penalty card, such as the card 38 as shown in FIG. 5 and this could involve the payment of play money such as shown at 39 to the other players or a bank depot.

During play of this game a currency or play money 39 is used and the players can qualify themselves as a different category of player, such as rookie or professional and the money game then becomes more interesting with each player then having opportunities to earn money with the always present danger of also loosing money. Various other forms of cards may be associated with the game, and the ones described herein are not to be construed as being limiting.

Each player is identified by a displacement element, such as the element 21 which are different from one another, either in having a part thereof of a different color or made differently and preferably associated with an element representative of the game of golf, such as shown in FIG. 6 wherein a golf ball 40 is formed at the top of a tee 41 supported on a disc-shaped support base 42.

It is within the ambient of the present invention to cover any obvious modifications of the preferred embodiments described herein, providing such modifications fall within the scope of the appended claims.

We claim:

1. A golf board game comprising a playing surface on which there is contained a plurality of designs representing golf links; each said golf links having a starting area, a fairway area and a green area; distance indicating means provided on said fairway and green areas, at least one manually displaceable element supportable on said playing surface, first displacement indicating means for providing for the displacement of said at least one manually displaceable element over said fairway area, second displacement indicating means to cause displacement of said displaceable element toward an objective associated with said green area there further being play money associated with said golf game as well as a plurality of distinct groups of cards utilized to instruct a player under predetermined situations during play.

2. A golf board game as claimed in claim 1 wherein said first displacement indicating means is provided by a plurality of shot cards, each said shot cards having on a surface thereof at lest two sections, each said section being provided with a location marking and a distance number to displace said displaceable element a predetermined distance calculated with said distance indicating means.

3. A golf board game as claimed in claim 2 wherein said at least two sections are also provided with a direction indicator associated with said distance number to indicate a specific direction that said displaceable element is to be displaced on said playing surface.

4. A golf board game as claimed in claim 3 wherein there are three of said sections on each said shot cards, said location marking on a first of said sections being indicative of a golf drive, another of said location marking on a second of said sections being indicative of a golf fairway shot, and a further of said location marking on a third of said sections being indicative of an approach golf shot.

5. A golf board game as claimed in claim 1 wherein said second displacement indicating means is a die having two distinct markings each provided on separate surfaces of said die and indicating a movement of said displaceable element into said objective which is provided on said green area or a non-movement of said displaceable element.

6. A golf board game as claimed in claim 5 wherein said displacement indicating means is provided on two dice, a first of said dice being utilized when said displaceable element is outside a putting zone, the other of said dice having a first of two distinct markings indicating the displacement of said displaceable element to said objective and the other of said distinct markings indicating a non-displacement, said objective being a golf cup marking on said green area.

7. A golf board game as claimed in claim 6 said two dice are of distinct color from one another.

8. A golf board game as claimed in claim 6 wherein said distinct markings of each said dice are comprised by a circle having an outside dot and a further circle having a central dot.

9. A golf board game as claimed in claim 8 wherein said first of said dice is provided with faces having more circles with said outside dot then circles with a central dot, the said other of said dice having equal number of faces with circles with an outside dot and circles with a central dot.

10. A golf board game as claimed in claim 1 wherein said second displacement indicating means is provided by a golf cup element supportable on a floor surface, a putter and a golf ball representative of said displaceable element.

11. A golf board game as claimed in claim 10 wherein said golf cup element is a circular disc having a progressively elevated top surface leading to a central elevated hole constituting said objective associated with said green area.

12. A golf board game as claimed in claim 11 wherein there is further provided simulating distance indicating elements to simulate on said floor surface the distance between said displaceable element on said green area and a golf cup marking on said green area.

13. A golf board game as claimed in claim 12 wherein further obstacle elements may be positioned on said floor area to obstruct the path of said golf ball toward said central elevated hole.

14. A golf board game as claimed in claim 1 wherein at least some of said golf holes are further provided with hazard areas, and a plurality of hazard cards associated with said areas and containing instructional information thereon.

15. A golf board game as claimed in claim 14 wherein said hazard areas are representative of wooded areas, water areas and sand areas, and drop zone markers associated with at least some of said hazard areas.

16. A golf board game as claimed in claim 1 wherein said distance indicating means is defined by a grid of straight lines substantially equidistantly spaced from one another and disposed substantially transversely over said fairway and green areas.

17. A golf board game as claimed in claim 16 wherein said grid of straight lines extending beyond said green area and disposed substantially transverse to an imaginary line extending from the center of said starting area to the center of said green area and following a central longitudinal axis of said fairway area.

18. A golf board game as claimed in claim 1 wherein said manually displaceable element is a golf-associated element having a distinct color to distinguish it from other displaceable elements of other game players.

19. A golf board game as claimed in claim 1 wherein said playing surface is a foldable game board having said golf links printed on opposed surfaces thereof.

20. A golf board game as claimed in claim 1 wherein said fairway area is provided with rough areas on opposed sides thereof to define side alleys in which said displaceable element may be positioned and displaced as directed by said first displacement indicating means.

21. A dice for use in a golf board game to displace a displaceable element on a green area of golf links printed on a playing surface of said board game, said dice being square cube having a plurality of square faces, some of said faces having a first type of indication markings to indicate a successful golf putt and a second type of indication markings to indicate a non-successful golf putt, there being two of said dice and each identified by a different colour, one of said dice having more of said square faces with said first type of indication markings, and the other of said dice having more of said square faces with said second type of indication markings.

22. A dice as claimed in claim 21 wherein said first type of indication markings comprise a circular ring with a small circular form therein.

23. A dice as claimed in claim 22 wherein said second type of indication markings comprise a circular ring with a small circular form disposed adjacent and outside said ring.

24. A golf board game comprising a playing surface on which there is contained a plurality of designs representing golf links; each said golf links having a starting area, a fairway area and a green area; distance indicating means provided on said fairway and green areas, at least one manually displaceable element supportable on said playing surface, first displacement indicating means for providing for the displacement of said at least one manually displaceable element over said fairway area, second displacement indicating means to cause displacement of said displaceable element toward an objective associated with said green area, said second displacement indicating means being a die having two distinct markings each provided on separate surfaces of said die and indicating a movement of said displaceable element into said objective which is provided on said green area or a non-movement of said displaceable element, said first displacement indicating means being provided on two dice, a first of said dice being utilized when said displaceable element is outside a putting zone, the other of said dice having a first of two distinct markings indicating the displacement of said displaceable element to said objective and the other of said distinct markings indicating a non-displacement, said objective being a golf cup marking on said green area, said distinct markings of each said dice being comprised by a circle having an outside dot and a further circle having a central dot, said first of said dice being provided with faces having more circles with said outside dot than circles with a central dot, the said other of said dice having equal number of faces with circles with an outside dot and circles with a central dot.

* * * * *